United States Patent [19]

Woodward

[11] Patent Number: 4,944,061

[45] Date of Patent: Jul. 31, 1990

[54] TOOL FOR UNCOUPLING INTERLOCKING BLOCKS

[76] Inventor: Daniel A. Woodward, 807 Briarwood Dr., West Palm Beach, Fla. 33415

[21] Appl. No.: 469,341

[22] Filed: Jan. 24, 1990

[51] Int. Cl.[5] ..... B24F 1/00

[52] U.S. Cl. ..... 7/170; 294/3; 294/99.2

[58] Field of Search ..... 7/170; 294/3, 99.1, 294/99.2

[56] References Cited

U.S. PATENT DOCUMENTS 3,628,824 12/1971 Leuw et al. ..... 294/99.2
4,223,936 9/1980 Jorgensen ..... 294/99.2
4,576,408 3/1986 Maneki ..... 294/99.2

FOREIGN PATENT DOCUMENTS 8903283 4/1989 PCT Int'l Appl. ..... 294/3

*Primary Examiner*—James G. Smith

[57] ABSTRACT

Two halves of a tool hinge about an axis. The hinging action causes one end of the tool to expand while the other end contracts. The expanding end is placed in a recess of the interlocking block befor expansion. After expansion, the expanding end of the tool grips the block. Similarly, the contracting end is placed around a post on the block. After contraction, the contracting end of the tool grips the post on the block.

9 Claims, 3 Drawing Sheets

TOOL FOR UNCOUPLING INTERLOCKING BLOCKS

BACKGROUND OF THE INVENTION

1. Field of the Invention

This invention relates to a tool for the uncoupling of interlocking blocks, for example, toy blocks used for building various structures.

2. Related Art

Interlocking blocks have become very popular, particularly with children, for building various structures and shapes. They are also used to construct models for evaluation and demonstration, such as buildings or machinery. However, a problem arises in that some of the blocks are difficult or impossible to separate without the use of some tool. Most often, a bladed object such as a knife is used. This damages the blocks and presents a hazard to the user.

SUMMARY OF THE INVENTION

The present invention provides a tool which may be used to grip a block, thus forming a handle to aid in releasing the block which is interlocked to another block.

Two halves of the tool pivot about an axis, being biased into a released position by an elastomeric member. Applying pressure to the tool halves at the end remote to the pivot axis causes one end of the tool to expand while the other end contracts.

In use, either the expanding end is placed in the block recess or the contracting end is placed around a block post. The block is gripped when the tool is activated by pivoting the halves using a pinching action. The interlocking blocks are separated by pulling the tool with the gripped block away from the mating block.

Broadly, the invention comprises a tool for uncoupling interlocking blocks, having two elongate members, each member having a semicylindrical recess at one end and a semicylindrical extension at the other end, the two members pivoted relative to each other at a position intermediate the ends, there being a small clearance between the members to permit pivoting. A resilient member, such as an elastmoeric ring retains the members together and biases the ends with the semicylindrical extensions together.

Pivoting of the members can cause the extensions to separate and grip the inside of a recess in a block, or the recesses to move towards each other and grip a post on a block.

Conveniently, the members are pivoted by hemispherical projections positioned in hemispherical recesses.

BRIEF DESCRIPTION OF THE DRAWINGS

The invention will be readily understood by the following description, in conjunction with the accompanying drawings, in which:

The drawings illustrate one particular form of tool according to the invention. As seen in FIGS. 1 to 6, the tool comprises top and bottom elongate halves 1 and 2, with an elastomeric ring 3 positioned in an annular groove 4 securing the halves together. At one end of the tool is formed a cylindrical extension 5. At the other end is formed a cylindrical recess 6. It will be appreciated that half of the cylindrical extension 5 is formed on each half 1 and 2 and half of the cylindrical recess is also formed on each half 1 and 2. This results in semicylindrical extensions at one end and semicylindrical recesses at the other end.

Figure 1:
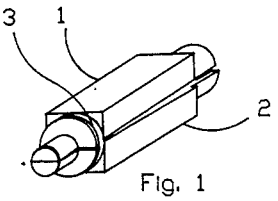
FIG. 1 is a perspective view showing the assembled tool.
Figure 2:
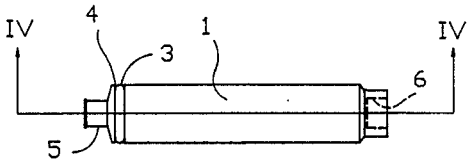
FIG. 2 is a plan view of the tool.
Figure 3:
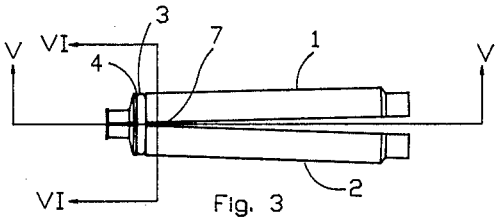
FIG. 3 is a side view of the assembled tool.
Figure 4:
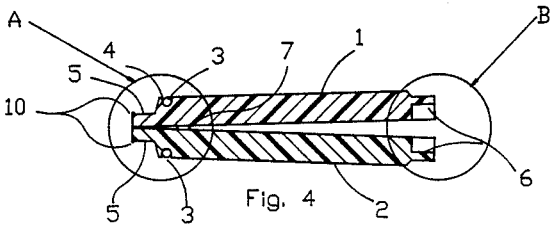
FIG. 4 is a cross section through the assembled tool illustrated in FIG. 1, generally on the line IV—IV of FIG. 2.
Figure 5:
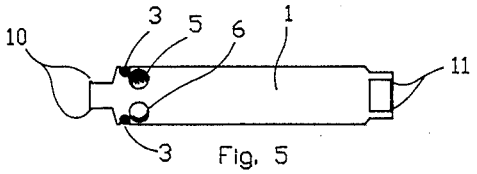
FIG. 5 is a cross section through the assembled tool illustrated in FIG. 3, generally on the line V—V of FIG. 3.
Figure 6:
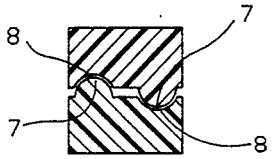
FIG. 6 is a cross section through the assembled tool illustrated in FIG. 3, generally on the line VI—VI of FIG. 3.

Adjacent the end having the cylindrical extension 5 is formed a pivoting arrangement. In the example, and as particularly seen in FIGS. 5 and 6, the pivoting is obtained by hemispherical projections 7 which seat in but project slightly from hemispherical recesses 8. The projections can be on one half and the recesses in the other half, but by having a projection and a recess on the same half, both halves are identical from the manufacturing aspect. By the projections projecting slightly from the recesses, a small clearance is provided between the halves. The elastomeric ring is positioned between the ends of the halves having the cylindrical extension 5 and the hemispherical projection 7 and thus the two halves pivot with the halves inclined away from each other, as seen in FIGS. 3 and 4.

Figure 7:
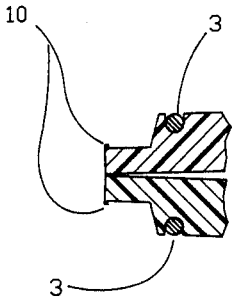
FIG. 7 is an enlarged view of the area in the circle "A" in FIG. 4.
Figure 8:
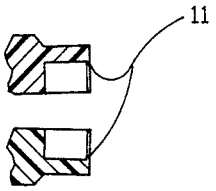
FIG. 8 is an enlarged view of the area in the circle "B" on FIG. 4.

FIGS. 7 and 8 illustrate the provision of annular stress concentrating ribs, 10 and 11 at the cylindrical extension and cylindrical recess respectively. These ribs ensure a good grip on a member.

Figure 9:
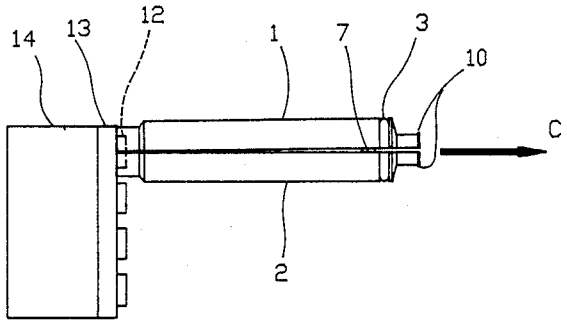
FIG. 9 is an example of the contracting end of the tool gripping the post of an interlocking block.

FIG. 9 illustrates the tool in use gripping a post 12 on a block 13. The post is gripped by squeezing the two halves together, the post being gripped in the cylindrical recess 6. While gripped the tool is pulled as indicated by arrow C, separating block 13 from block 14.

Figure 10:
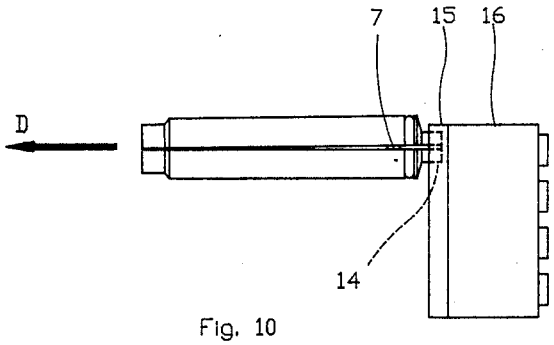
FIG. 10 is an example of the expanding end of the tool gripping a recess of an interlocking block.

In FIG. 10, the tool is used to grip the inside of a recess 17 in block 15. The cylindrical extension 5 is inserted into the recess 17 and then the remote ends squeezed together. This expands the extension 5 in the recess 17, giving a gripping action. By pulling on the tool, in the direction of arrow D, the block 15 can be released from block 16.

What is claimed is:

1. A tool for uncoupling interlocking blocks, comprising:

two elongate members, each member forming half of a tool;

a semicylindrical recess formed at one end of each member and a semicylindrical extension formed at the other end of each member;

pivotal means pivotally connecting the two members in apposition, intermediate said ends, the recesses and the extensions being in apposition to form a cylindrical recess at the one end of the tool and a cylindrical extension at the other end of the tool, said pivotal means forming a small clearance between the two members;

retaining means resiliently holding the two members in apposition, the retaining means being positioned between the pivotal means and the cylindrical extension.

2. A tool as claimed in claim 1, said pivotal means being positioned closer to said cylindrical extension.

3. A tool as claimed in claim 1, said pivotal means comprising hemispherical recesses and hemispherical projections, said hemispherical projections extending a small distance than the depth of the hemispherical recesses.

4. A tool as claimed in claim 3, one of said hemispherical recesses and one of said hemispherical projections positioned side by side on each member, the members being individually identical.

5. A tool as claimed in claim 1, said retaining means comprising an annular groove formed half in each member, and a resiliently extendable ring positioned in the groove.

6. A tool as claimed in claim 5, said resiliently extendable ring comprising an elastomeric ring.

7. A tool as claimed in claim 5, said annular groove positioned adjacent to the cylindrical extension.

8. A tool as claimed in claim 1, including an annular gripping ring at the outer end of said cylindrical extension.

9. A tool as claimed in claim 8, including an annular gripping member at an outer end of said cylindrical recess.

* * * * *